US005205084A

United States Patent [19]

Roberts

[11] Patent Number: 5,205,084

[45] Date of Patent: Apr. 27, 1993

[54] FLAT-WALLED APPARATUS AND HOUSING FOR TREATING HORIZONTAL SURFACES

[75] Inventor: Jerry W. Roberts, Oklahoma City, Okla.

[73] Assignee: Nelco Manufacturing Corporation, Oklahoma City, Okla.

[21] Appl. No.: 824,635

[22] Filed: Jan. 23, 1992

[51] Int. Cl.[5] ..... B24C 3/06; B24C 9/00

[52] U.S. Cl. ..... 51/429; 51/425

[58] Field of Search ..... 51/425, 424, 429, 410

[56] References Cited

U.S. PATENT DOCUMENTS

| | | | |
|---|---|---|---|
| 923,100 | 5/1909 | Young . | |
| 2,204,610 | 6/1940 | Minich | 51/9 |
| 2,254,234 | 9/1941 | Minich | 51/9 |
| 2,635,745 | 4/1953 | Mead et al. | 209/35 |
| 2,766,557 | 10/1956 | Pollard | 51/8 |
| 2,850,162 | 9/1958 | Widmer | 209/134 |
| 3,034,262 | 5/1962 | Pawlson | 51/9 |
| 3,380,196 | 4/1968 | Mabille | 51/9 |
| 3,877,175 | 4/1975 | Snyder | 51/9 |
| 3,900,969 | 8/1975 | Diehn | 51/9 |
| 3,906,673 | 9/1975 | Goto et al. | 51/9 |
| 3,934,372 | 1/1976 | Diehn | 51/9 |
| 3,934,373 | 1/1976 | Leliaert | 51/9 |
| 3,977,128 | 8/1976 | Goff | 51/424 |
| 3,981,104 | 9/1976 | Dreher | 51/429 |
| 4,020,596 | 5/1977 | Bergh | 51/9 |
| 4,052,820 | 10/1977 | Bergh | 51/423 |
| 4,222,205 | 9/1980 | Lake et al. | 51/420 |
| 4,336,671 | 6/1982 | Nelson | 51/424 |
| 4,364,823 | 12/1982 | Goff | 209/135 |
| 4,376,358 | 3/1983 | Shelton | 51/429 |
| 4,377,922 | 3/1983 | Bergh | 51/424 |
| 4,377,923 | 3/1983 | Bergh | 51/424 |
| 4,377,924 | 3/1983 | Bergh | 51/429 |
| 4,382,352 | 5/1983 | Nelson | 51/424 |
| 4,416,092 | 11/1983 | Nelson | 51/425 |
| 4,693,041 | 9/1987 | Dickson | 51/424 |
| 4,894,959 | 1/1990 | Hoover | 51/425 |
| 4,941,296 | 7/1990 | Carpenter | 51/433 |
| 5,090,162 | 2/1992 | Nelson | 51/425 |

FOREIGN PATENT DOCUMENTS

| | | | |
|---|---|---|---|
| 32161 | 4/1979 | European Pat. Off. . | |
| 0391440 | 10/1990 | European Pat. Off. | 51/424 |
| 2900 | of 1870 | United Kingdom . | |
| 487532 | 6/1938 | United Kingdom . | |
| 2093742 | 9/1982 | United Kingdom | 51/425 |
| 2203368 | 3/1988 | United Kingdom . | |

*Primary Examiner*—Robert A. Rose
*Attorney, Agent, or Firm*—Dunlap, Codding & Lee

[57] ABSTRACT

An apparatus for treating horizontal surfaces with abrasive particles. The apparatus utilizes a housing with flat, straight walls in a rebound chamber and a return corridor. Removable wearplates are attached to the inside walls of the rebound chamber to prevent wear on the rebound chamber walls. Abrasive particles are gravity-fed from a hopper to a blast drum having blades for propelling the abrasive particles to the surface to be treated. The abrasive particles rebound from the surface into the rebound chamber. The flat walls of the rebound chamber are arranged to divert the abrasive particles into the lower end of the return corridor with minimal wall contact. At the lower end of the return corridor the air flow from a dust collector takes over to draw the abrasive particles into a collection chamber. The abrasive particles pass through perforations in the wall of the collection chamber and into the hopper for reuse.

15 Claims, 2 Drawing Sheets

FLAT-WALLED APPARATUS AND HOUSING FOR TREATING HORIZONTAL SURFACES

FIELD OF THE INVENTION

The present invention relates to an apparatus and housing for treating a horizontal surface by propelling abrasive particles against the surface.

SUMMARY OF THE INVENTION

An apparatus constructed in accordance with the present invention comprises a housing with a feed hopper to hold and dispense abrasive particles, a flat-walled rebound chamber to contain abrasive particles striking the surface to be treated, a return corridor for reclaiming spent abrasive particles and a collection chamber to distribute abrasive particles back into the feed hopper. The housing has a bottom with a blast opening through which abrasive particles are propelled to strike the surface to be treated.

A rotating blast drum is mounted within the housing. The blast drum includes a plurality of radially extending blades for propelling abrasive particles through the blast opening and against the surface to be treated. A dust collector is attached to the housing to air wash the abrasive particles and to draw abrasive particles from the rebound chamber upward through the return corridor.

One object of the present invention is to provide an apparatus and housing with a flat-walled design, which allows easy replacement of wear-plates in areas of exposure to wear. Flat, rectangular wear-plates have the advantage of being simple and economical to produce.

Another object of the present invention is to provide an apparatus with a short, straight return path for abrasive particles. A short, straight return path of the abrasive particles allows the apparatus to operate with less abrasive material, a smaller feed hopper and a more compact design than conventional machines.

Other advantages and features of the present invention are apparent from the following detailed description when read in conjunction with the accompanying drawings and appended claims.

BRIEF DESCRIPTION OF THE DRAWINGS

FIG. 3 is a partly diagrammatical, sectional side view of the housing of the apparatus of FIG. 1.

DETAILED DESCRIPTION OF THE PREFERRED EMBODIMENTS

Figure 1:
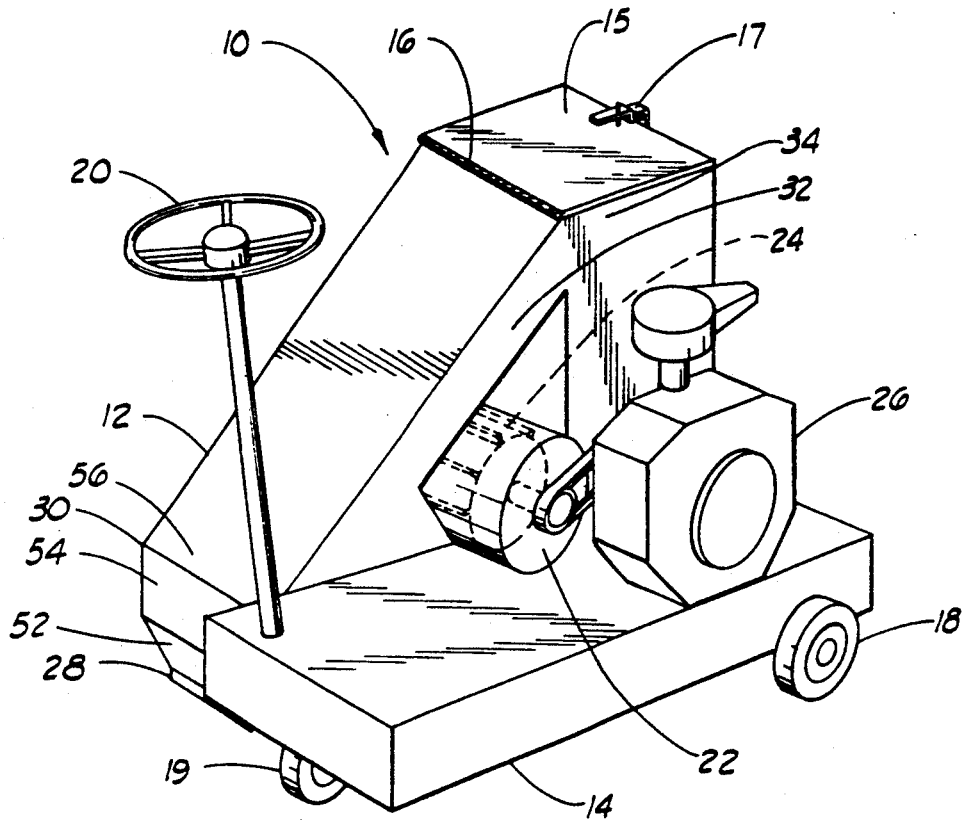
FIG. 1 is a perspective view of the operator's side of an apparatus constructed in accordance with the present invention. For simplicity of illustration, the dust collector is not shown.
Figure 2:
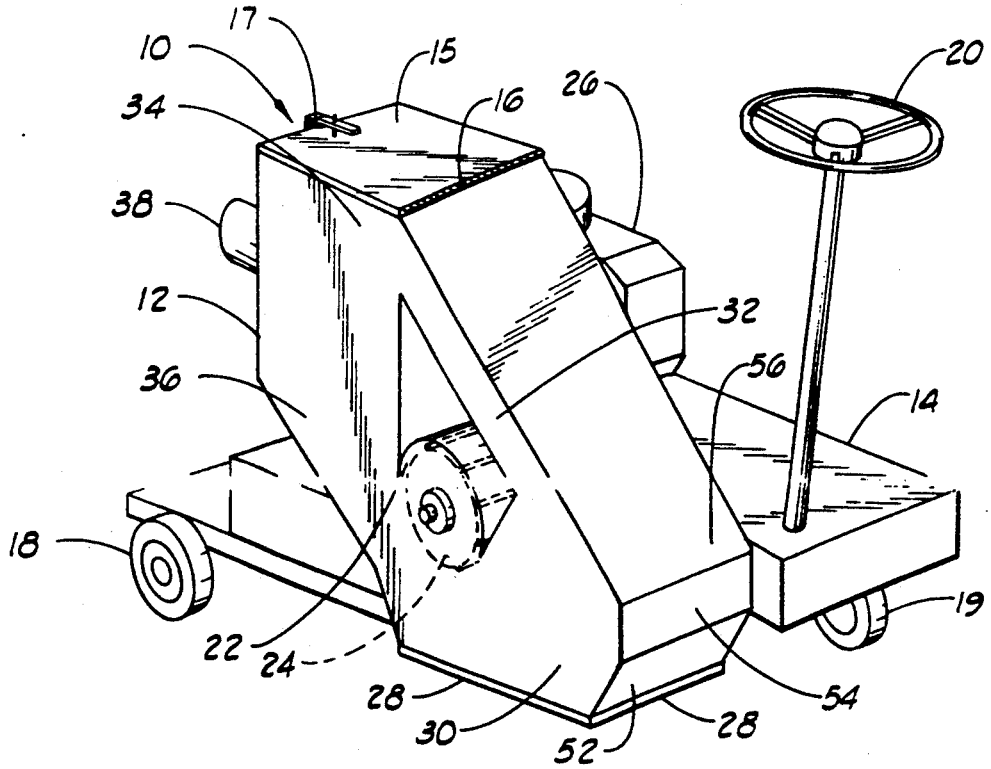
FIG. 2 is a perspective view of the housing side of the apparatus of FIG. 1. For purposes of simplicity, the dust collector is not shown.
Figure 5:
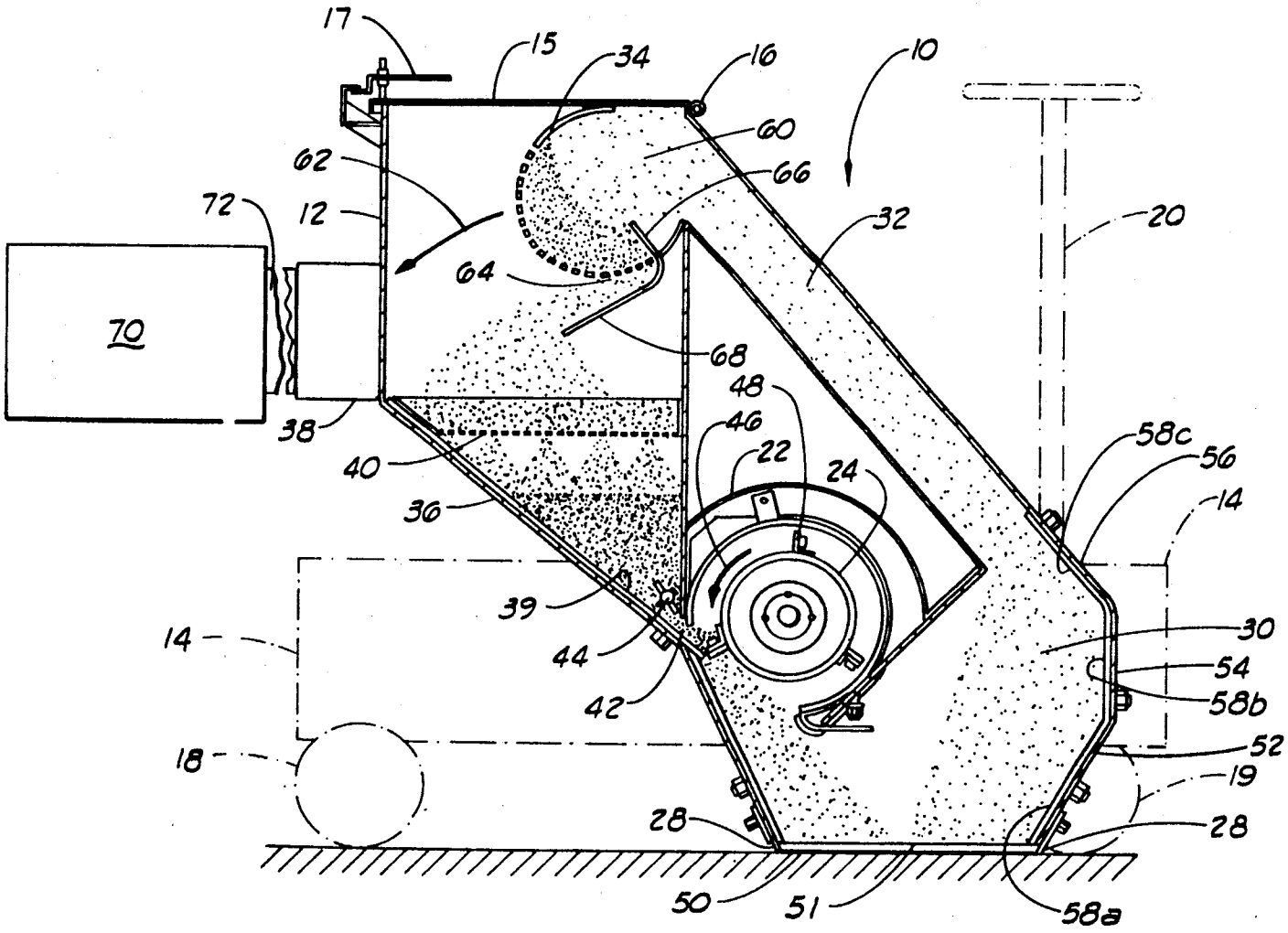

Referring to the drawings in detail, reference character 10 generally designates an apparatus constructed in accordance with the present invention. As shown in FIGS. 1 and 2, the apparatus 10 comprises a housing 12 adapted for movement over a substantially horizontal surface. The housing 12 is mounted to a mobile frame 14 and has an open bottom which serves as a blast opening. The top of the housing 12 has an access opening which is covered with an attached lid 15. The lid 15 is provided with a hinge 16 and latch 17. A pair of rear wheels 18 are mounted to the rear of the frame 14 and a front wheel 19 with a steering mechanism 20 is mounted to the front of the frame 14.

As best shown in FIG. 1, the housing 12 includes a blast housing 22 which contains a blast drum 24 (in phantom lines) for propelling abrasive particles through the blast opening against the surface to be treated. A motor 26 is provided to drive the rotation of the blast drum 24.

Referring now to FIG. 2, a seal 28 is attached around the blast opening of the housing 12 to prevent abrasive particles from escaping between the housing 12 and the surface to be treated. In addition to the blast housing 22, the housing 12 includes a rebound chamber 30 in the lower front portion of the housing 12, a return corridor 32 extending angularly and upwardly from the rebound chamber 30 toward the upper rear of the housing 12, a collection chamber 34 in the upper rear of the housing 12, and a feed hopper 36 below the collection chamber 34 and behind the blast housing 22. A dust duct 38 communicates with the collection chamber 34 and is provided for attachment of a dust collector to the housing 12. For simplicity of illustration, the dust collector is not shown in FIGS. 1 and 2.

FIG. 3 illustrates the internal construction of the housing 12. The frame 14, the rear wheels 18, the front wheel 19 and steering mechanism 20 are shown in phantom lines The hopper 36 extends across the housing 12 and is triangular in cross-section with the hypotenuse of the triangle sloping angularly downward toward the blast drum 24. A feed plate 39 extends across the hopper 36 and lines the inner surface of the hopper 36 wall angling downward. The upper end of the hopper 36 opens to the collection chamber 34. A strainer 40 extends across an upper portion of the hopper 36 to prevent objects larger than a predetermined size from entering the hopper 36. The abrasive particles used with the apparatus 10 are sized to fall readily through the strainer 40 and into the hopper 36 The lower end of the hopper 36 has a feed opening 42 to allow gravity feed of abrasive particles from the hopper 36 to the blast drum 24. A valve 44 is installed in the hopper 36 adjacent to the feed opening 42 to regulate the rate at which abrasive particles are fed to the blast drum 24.

The blast drum 24 is rotatably mounted in the blast housing 22 adjacent to the hopper 36. The direction of rotation for the blast drum 24 is indicated by direction arrow 46. The blast drum 24 has an outer periphery to which is secured a plurality of blades. One of the blades, designated by reference numeral 48, is generally representative of the blades of the blast drum 24. Each blade 48 extends radially outward from the blast drum 24 to travel proximate to the feed opening 42 of the hopper 36 as the blast drum 2 rotates. As shown in FIG. 3, the feed plate 39 extends below the valve 44 and forwardly past the valve 44 and the feed opening 42. Abrasive particles fall from the hopper 36 along the feed plate 39 past the valve 44 and through the feed opening 42. Upon reaching the forward edge of the feed plate 39, the abrasive particles are met by one of the rotating blades 48 of the blast drum 24. As shown in FIG. 3, the blades 48 of the blast drum 24 propel abrasive particles through the open bottom of the housing 12 to the surface to be treated as the blast drum 24 rotates The surface to be treated is designated by reference numeral 50 and the blast opening in the bottom of the housing 12 is indicated by reference number 51 in FIG. 3.

Upon striking the surface to be treated 50, the abrasive particles rebound by kinetic energy into the rebound chamber 30. The rebound chamber 30 preferably includes three front rebound walls: a lower rebound wall 52 extending angularly forward, a middle rebound wall 54 which is substantially vertical, and an upper rebound wall 56 extending angularly rearward. The rebound chamber 30 is provided with wear-plates 58*a*, 58*b* and 58*c* to absorb the wear from abrasive particles rather than subjecting the rebound walls themselves to the wear. Each wear-plate 58*a*–58*b*–58*c* is removably attached to the inner side of each rebound wall 52–54–56 of the rebound chamber 30. As illustrated by FIG. 3, each rebound wall 52–54–56 of the rebound chamber 30 is straight and flat. This straight, flat design allows easy replacement of the wear-plates 58*a*–58*b*–58*c* and the use of non-curved, easy-to-produce plates. In addition, the flat three-walled design results in minimal contact of the abrasive particles with the wear-plates 58*a*–58*b*–58*c*. The abrasive particles typically deflect off no more than two of the wear-plates 58*a*–58*b*–58*c* in traveling from the rebound chamber 30 to the return corridor 32. This construction sustains the kinetic energy of the rebounding abrasive particles until the abrasive particles reach the return corridor 32.

Continuing to refer to FIG. 3, the upper end of the rebound chamber 30 communicates with the return corridor 32. Like the rebound chamber 30, the return corridor 32 has straight, flat walls. This straight-line approach results in efficient return of spent abrasive particles for reuse.

The upper end of the return corridor 32 communicates with the collection chamber 34. The collection chamber 34 is a tubular structure extending across the housing 12 and having an area 60 which opens to the upper end of the return corridor 32. As shown in FIG. 3, the collection chamber 34 is substantially C-shaped in cross-section. The top of the collection chamber 34 is attached to the inside surface of the lid 15 of the housing 12. With the lid 15 closed, the front edge of the collection chamber 34 engages the housing 12 at the upper end of the return corridor 32 to ensure that all the abrasive particles from the return corridor 32 enter the collection chamber 34.

Continuing to refer to FIG. 3, the rear and lower walls of the collection chamber 34 are perforated. The perforations allow abrasive particles to fall through the collection chamber 34 into the hopper 36 and provide a passageway for air flow to the dust duct 38. This air flow is indicated by the direction arrow 62. A retaining plate 66 extends from the inside lower wall of the collection chamber 34 toward a central portion of the collection chamber 34 to hold abrasive particles within the collection chamber 34 before exiting through the perforated wall 64 of the collection chamber 34. A distribution plate 68 extends from the outside lower wall of the collection chamber 34 and across the width of the housing 12 to spread abrasive particles dropping from the collection chamber 34 into the upper end of the hopper 36.

As shown in FIG. 3, the dust duct 38 extends from the rear of the housing 12 above the hopper 36. The dust duct 36 is provided to attach a dust collector 70 to the housing 12 by means of a length of flexible duct 72 (partially shown). The dust collector 70 is preferably the type disclosed in U.S. Pat. No. 4,618,352, entitled "DUST COLLECTOR," which is hereby incorporated by reference. The dust collector 70 creates an air flow from the surface 50 around the seal 28 into the blast opening 51, through the rebound chamber 30 and return corridor 32, and through the perforations of the collection chamber 34. The dust collector 70 includes a damper which is used to adjust the force of the air flow. In operation, the air flow is adjusted to have sufficient force to draw abrasive material from the return corridor 32 into the collection chamber 34. The air flow should be weak enough, however, to allow the abrasive material in the collection chamber 34 to fall primarily by gravity from the collection chamber 34 into the hopper 36. The dust collector 70 receives the air from the blast area and removes dust and debris from the air.

In operation, abrasive particles gravity-feed past the valve 44 through the feed opening 42 to the blast drum 24. The blades 48 of the rotating blast drum 24 propel the abrasive particles through the blast opening 51 and against the surface to be treated 50. The abrasive particles strike the surface 51 and rebound by kinetic energy to the rebound chamber 30. In the rebound chamber 30, the abrasive particles may strike one or more of the flat wear-plates 58*a*–58*b*–58*c* of the rebound walls 52–54–56 to reach the lower end of the return corridor 32. Some abrasive particles, however, may rebound from the surface 50 directly into the return corridor 32 without striking any of the wear-plates 58*a*–58*b*–58*c*. Typically each abrasive particle deflects off no more than two of the wear-plates 58*a*–58*b*–58*c* of the rebound walls 52–54–56 before reaching the return corridor 32. As shown in FIG. 3, the wear-plate 58*c* of the upper rebound wall 56 extends into the lower end of the return corridor 32 to prevent wear on the return corridor 32 wall.

Once the abrasive particles reach the lower end of the return corridor 32, the air flow of the dust collector 70 takes over and draws the abrasive particles through the return corridor 32 and into the collection chamber 34. The air flow travels through the perforated wall 64 of the collection chamber 34 and on to the dust collector 70. The abrasive particles fall by gravity through the perforated lower wall 64 of the collection chamber 34, through the strainer 40 and into the hopper 36 for subsequent reuse.

The apparatus 10 may be constructed various sizes in order to treat a wide range of surfaces having different shapes and areas. A small version of the apparatus 10 may have a treatment path of 5 inches or less in width for use in confined spaces and may be pushed or pulled by the operator. A large model of the apparatus 10 may be built with a treatment path from 5 inches to 16 inches and wider for efficient use over expansive areas. In large sizes, the apparatus 10 may be equipped with an engine and drive train to be self-propelled and may have a riding seat for the operator.

Changes may be made in the combinations, operations and arrangements of the various parts and elements described herein without departing from the spirit and scope of the invention as defined in the following claims.

I claim:

1. An apparatus for treating a substantially horizontal surface by blasting the surface with abrasive particles, the apparatus comprising:

a housing having a bottom with a blast opening adapted to overlie a substantially horizontal surface;

a rotatable drum within the housing, the drum having an outer periphery with a plurality of radially extending blades for propelling abrasive particles through the blast opening and against the surface;

a hopper having an upper end and a lower end within the housing for holding and releasing abrasive particles, the hopper having a feed opening positioned at the lower end of the hopper to gravity-feed abrasive particles into contact with the blades of the drum as the drum rotates;

a rebound chamber within the housing, the rebound chamber having a plurality of flat rebound walls and communicating with the blast opening;

a return corridor within the housing, the return corridor having an upper end, a lower end, and flat, straight walls, the lower end of the return corridor communicating with the rebound chamber;

a collection chamber within the housing above the hopper and communicating with the upper end of the return corridor for collecting abrasive particles for reuse, the collection chamber communicating with the hopper to gravity feed abrasive particles from the collection chamber into the hopper; and means communicating with the housing for creating an air flow from the blast opening through the rebound chamber, and return corridor and the collection chamber;

wherein the return corridor extends linearly into communication with the collection chamber.

2. The apparatus of claim 1 wherein the return corridor has a substantially constant cross-section from the lower end to the upper end thereof.

3. The apparatus of claim 1 wherein the hopper includes a strainer extending across the hopper at an upper level of the hopper to prevent objects larger than a predetermined size from falling into the lower end of the hopper.

4. The apparatus of claim 3 wherein the hopper includes a valve at the feeding opening of the hopper to control the quantity of abrasive particles feeding into contact with the blades of the drum.

5. The apparatus of claim 3 wherein the hopper has an inner lower wall lined with a feed plate extending across the hopper to direct abrasive particles into contact with the blades of the drum.

6. The apparatus of claim 5 wherein the feed plate is replaceable.

7. The apparatus of claim 1 wherein the housing includes a seal around the blast opening to prevent escape of abrasive particles between the housing and the surface to be treated.

8. The apparatus of claim 1 wherein the rebound walls of the rebound chamber are lined with wear-plates.

9. The apparatus of claim 8 wherein the wear-plates are replaceable.

10. The apparatus of claim 1 wherein the means for creating an air flow is a dust collector.

11. The apparatus of claim 1 wherein the collection chamber has a plurality of perforations therethrough, the perforations being sized to allow abrasive particles to pass from the collection chamber into the hopper.

12. The apparatus of claim 11 wherein the collection chamber has a C-shaped cross-section and each end of the "C" engages the housing to allow passage of abrasive particles from the collection chamber into the hopper exclusively through the perforations of the collection chamber.

13. The apparatus of claim 12 wherein the housing has an upper end with an access opening and a lid, the lid being movable between a closed position covering the access opening and an open position exposing the access opening.

14. The apparatus of claim 13 wherein the collection chamber is attached to the lid and extends within the housing when the lid is in the closed position.

15. The apparatus of claim 13 wherein the collection chamber further comprises:

a retaining plate extending from an inner lower portion of the collection chamber at a point proximate to the upper end of the return corridor; and a distribution plate extending angularly downward from an outer lower portion of the collection chamber toward the hopper to distribute abrasive particles into the hopper as abrasive particles pass through the perforations of the collection chamber.

* * * * *

UNITED STATES PATENT AND TRADEMARK OFFICE

CERTIFICATE OF CORRECTION

PATENT NO. : 5,205,084

DATED : April 27, 1993

INVENTOR(S) : Jerry W. Roberts

It is certified that error appears in the above-identified patent and that said Letters Patent is hereby corrected as shown below:

Column 2, line 27, after "lines", insert --.--.

Column 2, line 39, after "36", insert --.--

Column 2, line 54, delete "2" and insert --24--.

Column 2, line 65, after "rotates", insert --.--.

Column 6, line 37, after "chamber" insert -- toward an interior portion of the collection chamber--.

Signed and Sealed this

Fourth Day of January, 1994

Bruce Lehman

*Attest:*

BRUCE LEHMAN

*Attesting Officer*

*Commissioner of Patents and Trademarks*